United States Patent [19]

Romagnoli

[11] Patent Number: 4,853,071

[45] Date of Patent: Aug. 1, 1989

[54] APPARATUS FOR THE CONDITIONING IN ENVELOPES OF INDIVIDUAL DUAL-USE FILTER SACHETS IN AMCHINES FOR THE CONTINUOUS PRODUCTION OF SUCH FILTER SACHETS

[75] Inventor: Andrea Romagnoli, San Lazzaro Di Savena, Italy

[73] Assignee: Cestind - Centro Studi Industriali-S.R.L., Osteria Grande-Castel, Italy

[21] Appl. No.: 154,783

[22] Filed: Feb. 10, 1988

[30] Foreign Application Priority Data

Mar. 9, 1987 [IT] Italy ..... 3381 A/87

[51] Int. Cl.[4] ..... B65B 63/04

[52] U.S. Cl. ..... 156/443; 53/134; 53/234

[58] Field of Search ..... 53/429, 461, 463, 205–206, 53/220, 225, 134, 234; 156/226, 227, 443, 204, 475, 476, 477.1, 479, 483–485

[56] References Cited

U.S. PATENT DOCUMENTS 3,566,573 3/1971 Irmscher ..... 53/134 X
3,774,369 11/1973 Klar ..... 53/134
3,969,873 7/1976 Klar ..... 53/234 X
4,021,993 5/1977 Widmer ..... 53/234 X
4,288,224 9/1981 Romagnoli ..... 53/134 X

*Primary Examiner*—David Simmons
*Attorney, Agent, or Firm*—Herbert Dubno

[57] ABSTRACT

An apparatus for the conditioning in envelopes of individual dual-use filter sachets, obtained from a flattened tube of thermally weldable filter paper, having multiple bags or pouches defined by transverse thermal welds in continuous production machines, with labels, thread and fastening tabs for same, cutting the tube into portions comprising at least two pouches across the fastening tabs, folding the portions in fan-shape along the intermediate transverse thermal weld and setting up these pouches adjacent to each other for joining the corresponding adjacent extremities. Such an apparatus has a device for feeding portions of packing paper located underneath said multiple pouches folded into fanshape between the folding and transfer unit capable of transferring the pouches through a fixed folder effecting a U-shaped fold between the prongs of pincers of an intermittently rotating pincer wheel for joining the aforesaid adjacent extremities and for peripherally sealing the envelope enclosing the sachet.

2 Claims, 4 Drawing Sheets

APPARATUS FOR THE CONDITIONING IN ENVELOPES OF INDIVIDUAL DUAL-USE FILTER SACHETS IN AMCHINES FOR THE CONTINUOUS PRODUCTION OF SUCH FILTER SACHETS

FIELD OF THE INVENTION

The present invention relates to an apparatus for packing in envelopes, individual dual-use filter sachets made in machines for the continuous production of such filter sachets.

BACKGROUND OF THE INVENTION

From the Italian patent application No. 3376 A/87 corresponding to my copending U.S. application No. 07/154,782 filed Feb. 10, 1988, an automatic machine is known for the continuous production of dual-use filter sachets for infusion products. Such dual-use sachets comprise two containment bags or pouches containing fractional doses of the infusion products. The machine comprises along the production line a succession of means for making the dual-use sachets including at the upstream side of the manufacturing path a means designed to progressively fold and longitudinally seal a strip of thermally weldable filter paper fed with the fractional doses having a flattened tubular form and oriented horizontally. This means is followed by a means for thermally welding the tube transversely so as to enclose individual fractional doses between two of said successive thermal weld.

A means with rotating wheels having pickup elements then applies to the flattened tube equidistantly spaced labels, a continuous longitudinal thread transversely contacting said labels, as well as thermally weldable stickers or tabs across alternate transverse thermal welds partly to the back of said labels.

The tube then encounters means for cutting the tube into pieces comprising at least two pouches each and for setting up said bags adjacently and for sealing together their extremities.

More particularly, such a dual-use sachets of filter paper with multiple successive or serieal bags or pouches each containing a corresponding fractional dose or unit quantity of the infusion products, has a structure with two arrangements of use, namely one in its flattened form packaged for sale in lots with said bags or pouches arranged superimposed on each other or arranged back to back by folding one bag or pouch over the adjacent one, and in an unfolded or extended arrangement of said pouches following action by pressing and pulling by the user of the corresponding label covering the handling thread of the said filter sachet. The said thread has a length which is substantially equal to the length of the sachet in its position with unfolded bags or pouches, and is fastened to the opposite extremity of the sachet by means of a sticker or tab made of thermally weldable material jointly with the label made of nonthermally weldable paper in proximity to one of these opposite extremities and is arranged to pass longitudinally around the outside of the sachet when the bags or pouches are stacked in lots for sale with the pouches folded back to back.

OBJECT OF THE INVENTION

The object of the present invention is an apparatus for the packing in envelopes of the individual dual-use filter sachets thus obtained in the aforementioned machine.

SUMMARY OF THE INVENTION

According to the invention, the bag-making machine as described above is further provided with means for infeeding envelope paper located underneath said portions with multiple pouches folded back fan-fashion being transferred with the aid of the second folding-transfer means below the folding-transfer elements of the latter between four folding-transfer elements capable of holding together said multiple-pouch portions folded back in fan-shape and the underlying portion of envelope paper in registration with the fan-shaped fold and to transfer same to pass through a third stationary folding means to be arranged in a substantially U-shaped fold, between the pincer prongs of an intermittently moving pincer wheel rotating about a horizontal axis; means arranged along the trajectory of said intermittently rotating pincer wheel for joining the adjacent terminal extremities of said portions with adjacently folded pouches with the aid of thermally weldable half-tabs and further means being provided for re-folding and peripherally sealing said folded portions of envelope paper enclosing said filter sachets with folded-back adjacent pouches.

BRIEF DESCRIPTION OF THE DRAWING

Further features and advantages of the rotary-wheel apparatus according to the present invention will be better apparent from the following detailed description of one of its preferred embodiments given here solely by way of example with reference to the accompanying drawing in which:

FIGS. 4A–4M illustrate diagrammatically the production line with its particular functions of the said apparatus according to the invention.

SPECIFIC DESCRIPTION

Figure 1:
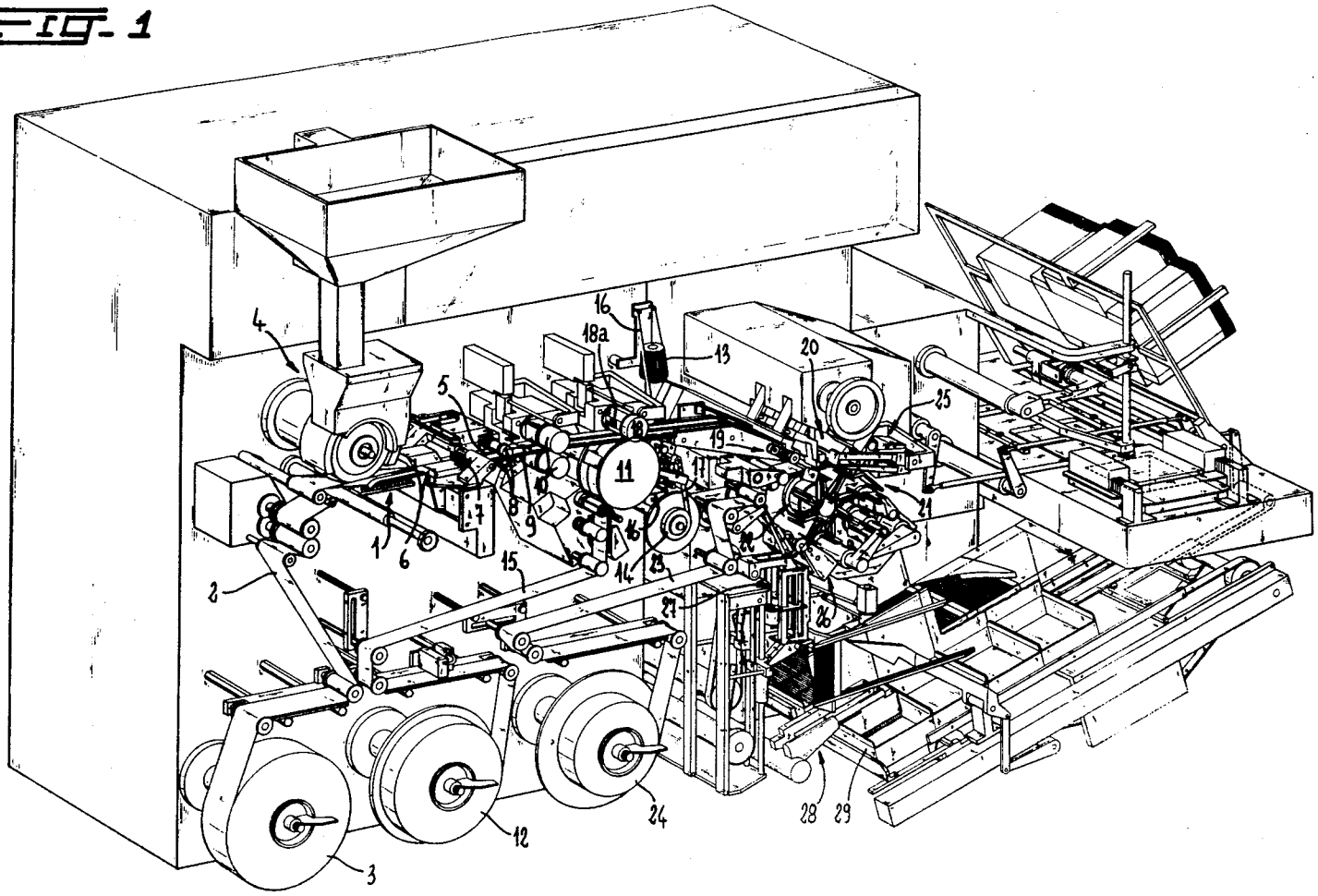
FIG. 1 is a front elevational view of the bag production machine fitted with the apparatus according to the invention, seen in perspective.
Figure 2:
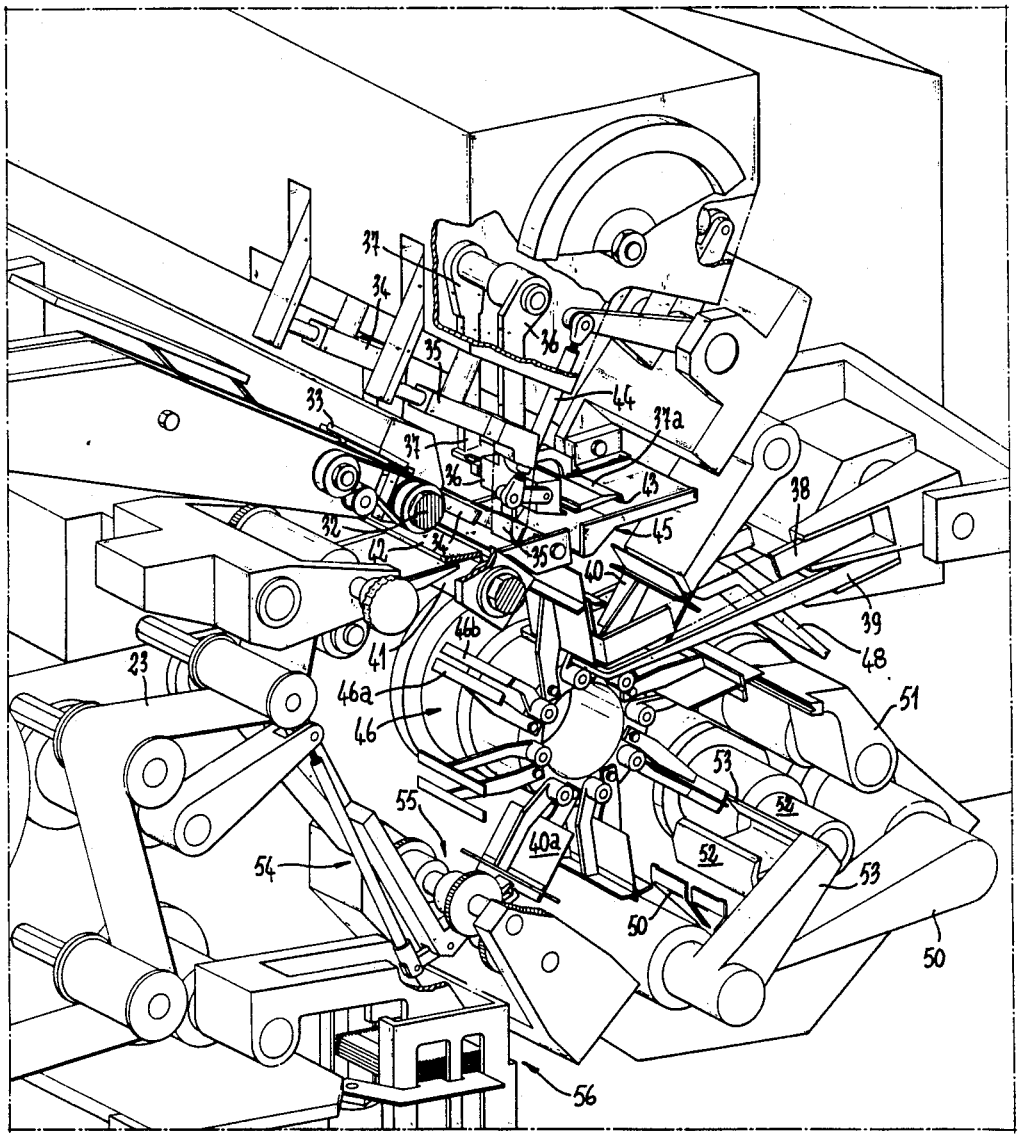
FIG. 2 is a perspective front elevational view on an enlarged scale, showing that part of the production machine which involves the apparatus according to the invention.

The production machine shown in FIG. 1 is the one described and claimed in the above-cited Italian patent application No. 3376 A/87 corresponding to my copending U.S. application No. 07/154,782 filed Feb. 10, 1988, employing the apparatus according to the present invention an integrated production line, namely for the continuous formation of dual-use filter sachets with successively or serially arranged bags or pouches each containing a fractional dose of the infusion product, folded back-to-back relative to each other and provided with labels and thread for their handling by the user with said pouches in a unfolded arrangement one following the other, for the packaging of the individual filter sachets in respective outer envelopes, and for the subsequent collection of the envelopes in lots of the said filter sachets in cartons or boxes for storage and scale.

The integrated production line of the machine essentially comprises a succession of means for the continuous production of the dual-use filter sachets and including:

means 1 for supporting and folding into a substantially flattened tubular form, a strip 2 of thermally weldable filter paper drawn in continuous movement from a reel 3 in a substantially horizontal orientation;

feeder-doser means 4 to feed equidistantially spaced doses of the infusion product onto and along the said continuously moving strip 2 of thermally weldable filter paper as it is being folded by the action of the support and folding means 1 into said substantially flattened tubular form, the longitudinal edges of said strip 2 being in vertically extending mutual contact to form a longitudinal crest 5;

means with knurling rollers 7 operating on the longitudinal crest 5 to seal the same by a knurling action;

means 8 with rollers and counter-rollers spaced respectively in transverse direction capable of operating laterally relative to the sealed and knurled longitudinal crest 5 on the continuously moving strip of filter paper in its substantially flattened tubular form to entrain said strip while enhancing and maintaining its flattening;

leaf-spring folding means 9 capable of folding back laterally said welded and knurled longitudinal crest 5 on said strip of filter paper in said flattened tubular form;

welding means 10 with rollers and counter-rollers capable of thermally welding the continuously moving strip of filter paper in its flattened tubular form transversely between two fractional doses of infusion materials so as to enclose the fractional doses between successive transverse thermal welds;

rotary wheel or head means 11 provided with pickup elements to feed from respective feed reels 12, 13, 14 located underneath and into contact with the continuously moving strip of filter paper in its flattened tubular form, a succession of labels cut from the strip 15 of reel 12, each of which is spaced relative to the median transverse line of the alternate transverse thermal welds, a longitudinal thread 16 drawn from reel 13 transversely contacting the outer surface of the said succession of labels and further a succession of stickers or tabs cut from strip 17 of reel 14 of thermally weldable material applied across the alternate transverse thermal welds partly to the back of said labels;

roller means 18 with peripherally equidistant thermal pressure pads designed to cooperate in counter-rotation with the rotary wheel or head means 11 having holding elements so as to thermally weld, with the aid of the thermal pressure pad elements, the stickers or tabs of thermally weldable material to the thread and the latter to the labels and to weld as well as the thread to the continuously moving strip of filter paper in the flattened tubular form across the alternate transverse thermal welds;

cutting means 19 for cutting up the continuously moving flattened tube provided with labels, longitudinal thread, as well as stickers or tabs of thermally weldable material in registration with the median transverse line of the transverse alternate thermal welds into portions or segments each comprising at least two successive bags or pouches;

folding and conveying means 20 to fold and convey said portions or segments of the strip of filter paper in flattened tubular form with at least two filter bags or pouches relative to the median line of the corresponding intermediate transverse thermal weld so as to superimpose the bags on each other or back up the bags or pouches against one another;

thermal welding means 21 capable of joining by means of thermal welds the respectively resulting adjacent transverse terminal edges with the aid of the corresponding stickers or tabs made of thermally weldable material;

rotary wheel means 22 with radial pincers;

means for infeeding and for folding into a V portions of the envelope paper cut from the strip 23 drawn from reel 24;

means 25 for transferring said filter sachets between the leaves of the paper portions folded in V;

means for transferring said portions of paper folded in V with insertion of corresponding filter sachet between said radial pincers of said rotary wheel means 22;

means 26 for sealing the edges of the said parts folded in V to form envelopes containing the corresponding filter sachet;

means 27 for stacking said envelopes, and means 28 for transferring said stacks of envelopes into preformed cartons or boxes.

Figures 3, 3A:
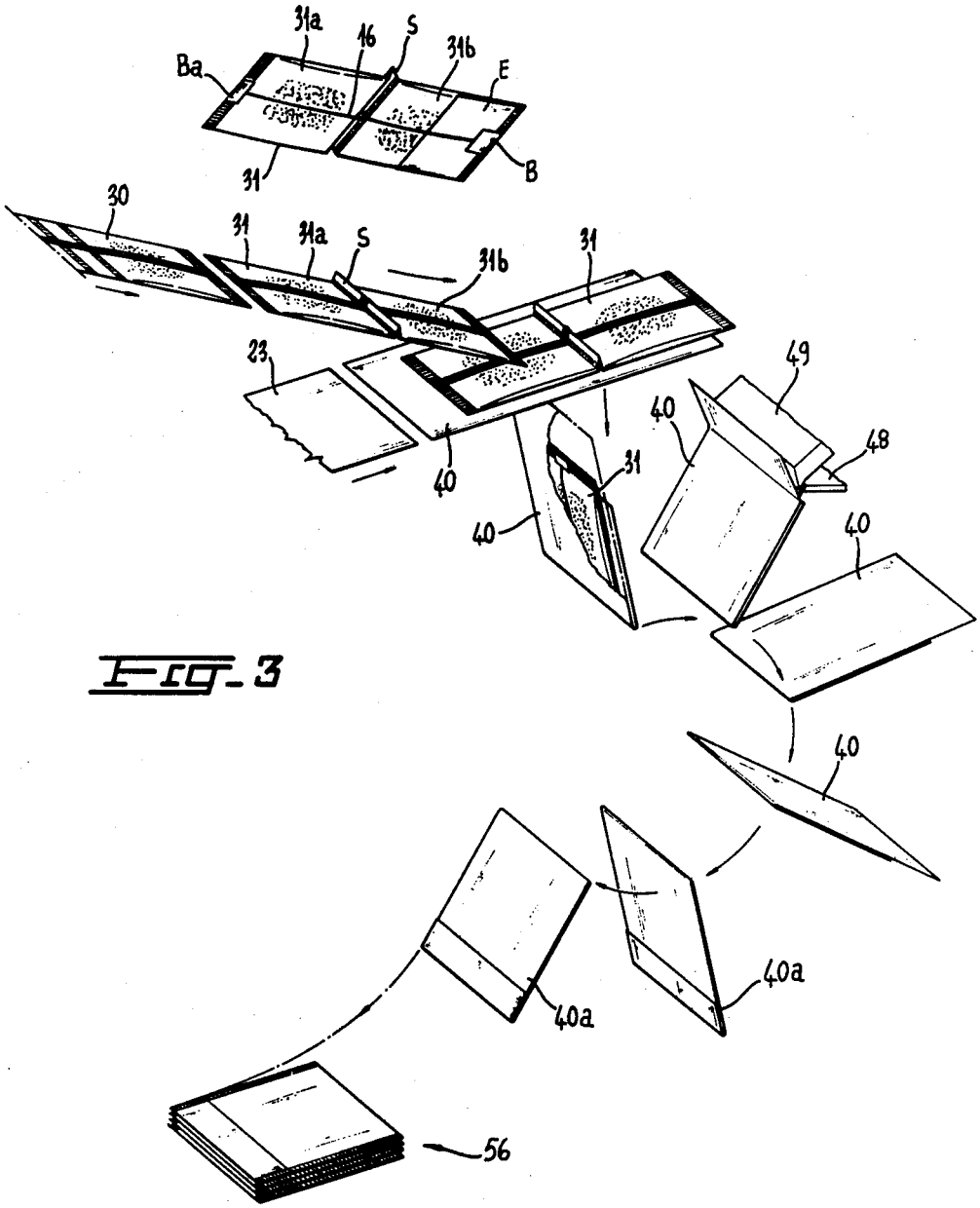
FIG. 3 shows, on a still more enlarged scale and again in a perspective view of front elevation, a succession of operations as carried out by the apparatus.
FIG. 3A is a detail of FIG. 3.

As stated above, the object of the present invention is an apparatus for the packing in envelopes of individual dual-use filter sachets in automatic machines for the continuous production of said filter sachets, more particularly based on the apparatus according to the Italian patent application No. 3380 A/87 corresponding to U.S. application No. 07/154,782 filed concurrently herewith, designed for sectioning the aforesaid continuously moving strip of filter paper 30 in its flattened tubular form (see FIG. 3) thus fitted with labels E, longitudinal thread 16 and thermally weldable stickers or tabs B in registration with the aforesaid transverse median line of the said alternate thermal welds into portions or segments 31 comprising at least two successive bags or pouches (see FIGS. 3 and 3A). These bags can then be refolded and conveyed in segments 31 of strip 30 so as to superimpose the bags on each other or to set up these bags or pouches back to back and to join the respectively resulting adjacent transverse terminal edges with the aid of the intervening half-stickers or half-tabs B and Ba of thermally weldable material (see again FIGS. 3 and 3A).

Figure 4A:
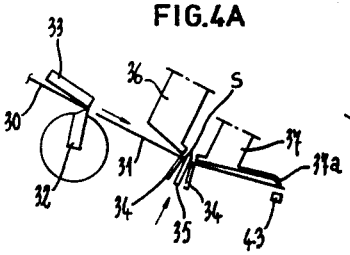
Figure 4B:
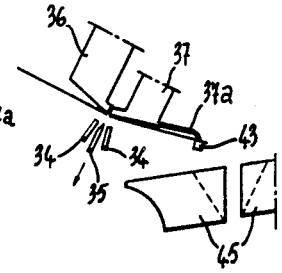
Figure 4C:
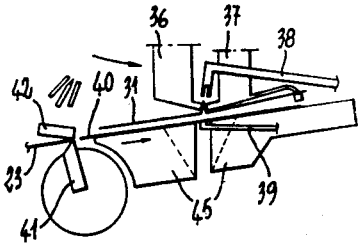
Figure 4C:
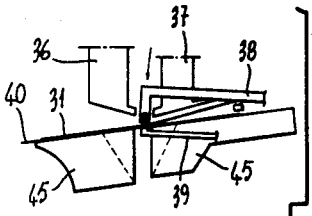
Figure 4D:
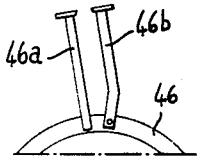
Figure 4E:
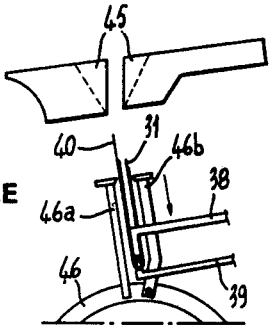
Figure 4F:
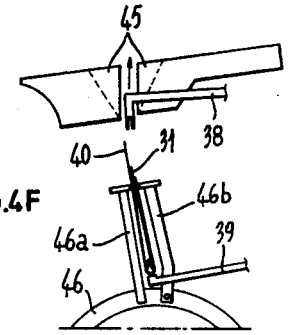

Referring now particularly to FIGS. 2 and 4A–4M, such an apparatus according to the invention provides for the use of a rotating knife 32 and a stationary knife 33 for cutting said strip 30 across said tabs B into said portions 31 comprising two bags or pouches **31*a* and 31*b* (FIGS. 4A and 3A) bearing the opposite extremities of a corresponding half-tab B and Ba and mobile folding means 34 and 35 capable of refolding in the shape of a ridge or fan S the same portions 31 (see FIGS. 4A and 4B) for conveying the latter between holding means 38 and 39 above a portion of envelope paper 40 cut by means of rotary knife 41 and stationary knife 42 from the strip 23 fed in by reel 24. This transfer of the portion 31 by means of the pincer elements 36 and 37 also involves an extension 37*a* of pincer element 37, in co-operation with a mobile element 43 actuated by a lever 44 (see FIGS. 2 and 4A, 4B and 4C**).

The arrangement of the portion 31 on the underlying portion of paper 40 is one in which it overhangs the latter with its downstream extremity in the direction of its transfer movement, while the upstream extremity of paper portion 40 protrudes relative to the other extremity of this portion 31.

Figure 4G:
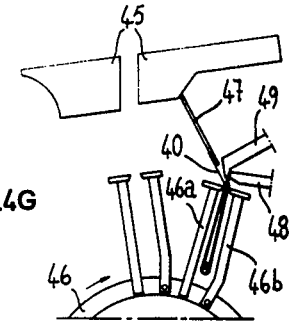

Such a set or assembly of portion 31 and portion 40 is picked up by the aforesaid holding means 38 and 39 registering with the ridge (FIG. 4D) and, cause to pass through fixed, funneling folding means 45 so as to refold portion 31 on the sides opposite to that folded in fan-shape S together with portion 40, folded into a U-shape between prongs **46*a* and 46*b* of the pincer of an intermittently moving pincer wheel 46, pincer 46*a* being stationary and pincer 46*b* being mobile; so as to protrude with said respective terminal parts folded in U-shape from the prongs 46*a* and 46*b*. At this instant, while the prongs 46*a* and 46*b* provide for holding the aforesaid U-shaped arrangement, the aforesaid pincer means 38 and 39 are caused to return into their initial position of opening (FIG. 4F) and the wheel 46 rotates by one step (FIG. 4G). In the course of this displacement by one step, a deflector 47 causes the longer terminal edge of portion 40 to move away from the portion 31, so as to enable the stationary and mobile welding means, respectively referenced 48 and 49, to weld together the opposing extremities of the portion 31** again with the aid of the aforesaid thermally weldable half-tabs B and Ba (see FIG. 4G).

Figure 4H:
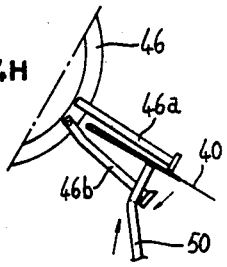
Figure 4I:
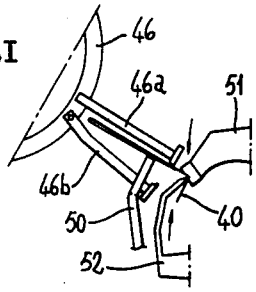
Figure 4L:
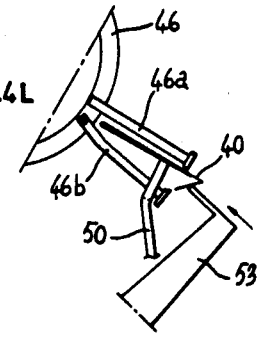
Figure 4M:
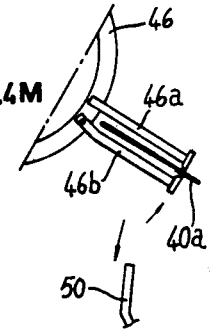

Following the execution of this welding operation, the wheel 46 rotates by another step into a rest position, and thereafter executes a further step (FIG. 4H). In this position of FIG. 4H, a lever 50 maintains the set of portion 31 and portion 40 in position so as to enable the opening of prong **46*b* to allow the levers 51 and 52 to fold back the terminal part of portion 40 in the form of an envelope closure border or flap of portion 40 (FIG. 4I) and to allow the lever 53 to fold back this closure border against the same portion 40 folded into envelope pack 40*a* (FIG. 4M). By the further rotations with successive steps of wheel 46, the said sachet-pack set is moved to register with a system of pickup levers 54 where it is seized, passed between knurling rollers 55 for peripheral sealing of said envelope pack and then deposited in a collecting and stacking tray 56** for subsequent handling and conditioning for sale.

I claim:

1. An apparatus for making infusion packets which comprises:

means for feeding a strip of thermally weldable filter paper along a transport path;

means along said path for feeding successive measured quantities of an infusion product onto said strip;

means along said path for folding said strip into a flattened tube around said infusion product and for forming transverse and longitudinal seals across and along said strip to define individual bags each containing a measured quantity of said infusion products;

means along said path for applying labels, tabs and strings to said strip and for severing segments of said strip from one another along alternate transverse welds to form respective segments each comprising two of said bags joined by an intervening weld;

means downstream of said path for forming in each segment a fanfold along the intervening transverse weld thereof;

means for feeding pieces of envelop paper into registry with each of said segments;

stationary folding means for folding the bags of each segment along said fanfold and simultaneously folding the respective piece of envelope paper to flank said bags and form an assembly of each folded segment and the respective folded piece of paper;

a pincer wheel formed with pincers engageable with said assembly for displacing same along a trajectory;

means along said trajectory for joining the edges of said bags of each segment remote from the respective fanfold; and means along said trajectory for folding a flap of each piece of paper over the sealed remote edges of the respective pair of bags and sealing edges of said piece of paper to close an envelope formed by said piece of paper around the respective pair of bags.

2. The apparatus defined in claim 1 wherein the last-mentioned means includes means for retaining each assembly in position between open pincers and said pincer wheel;

means including a folding lever and counterlever for folding said flap over said remote edges of said bags;

pincers engageable with the assembly upon closure of said flap for transferring each said assembly from said pincer wheel; and rollers receiving the assemblies transferred from said pincer wheel for sealing edges of the respective envelopes.

* * * * *